US006445133B1

(12) United States Patent
Lin et al.

(10) Patent No.: US 6,445,133 B1
(45) Date of Patent: Sep. 3, 2002

(54) INCANDESCENT LAMP WITH INTEGRAL VOLTAGE CONVERTER

(75) Inventors: Lin Lin, Alsip; Thomas S. Hendrickson, Crestwood, both of IL (US)

(73) Assignee: Litetronics International, Inc., Alsip, IL (US)

( * ) Notice: Subject to any disclaimer, the term of this patent is extended or adjusted under 35 U.S.C. 154(b) by 0 days.

(21) Appl. No.: 09/910,561

(22) Filed: Jul. 23, 2001

(51) Int. Cl.[7] ..... H01J 13/46

(52) U.S. Cl. ..... 315/57; 315/58; 315/209 R; 315/255; 315/362; 362/265; 362/448

(58) Field of Search ..... 315/57, 58, 49, 315/70, 72, 212, 255, 209 R, 200 R, 276, 291, 362, DIG. 7; 362/265, 296, 364, 441, 448

(56) References Cited

U.S. PATENT DOCUMENTS

| | | | | |
|---|---|---|---|---|
| 2,587,169 A | | 2/1952 | Kivari | 315/70 |
| 3,355,612 A | | 11/1967 | Peek | 313/35 |
| 3,525,012 A | | 8/1970 | Dimitracopoulos et al. | 315/70 |
| 4,112,336 A | | 9/1978 | Rios | 315/362 |
| 4,443,778 A | | 4/1984 | Mewissen | 336/90 |
| 4,464,607 A | | 8/1984 | Peil et al. | 315/209 R |
| 4,682,276 A | * | 7/1987 | Miller | 362/263 |
| 4,998,044 A | | 3/1991 | Nilssen | 315/200 |
| 5,585,697 A | | 12/1996 | Cote et al. | 315/157 |
| 6,147,457 A | | 11/2000 | Lohn et al. | 315/209 R |

* cited by examiner

*Primary Examiner*—Haissa Philogene
(74) *Attorney, Agent, or Firm*—Seyfarth Shaw

(57) ABSTRACT

An incandescent lamp is designed to operate at lower than the AC line voltage and includes a voltage conversion circuit for lowering the line voltage to the operating voltage of the lamp. The circuit includes an output transformer which is disposed in the screw base of the lamp, the remainder of the circuit, which is high-temperature-intolerant, being disposed outside the base and the envelope of the lamp. In a reflectorized embodiment of the lamp, the high-temperature-intolerant portion of the circuit is disposed adjacent to the mouth of the reflector envelope on the outer surface thereof and, in a non-reflectorized bulb embodiment, the high-temperature-intolerant portion is disposed between the envelope and a skirt which is connected to the base.

20 Claims, 3 Drawing Sheets

INCANDESCENT LAMP WITH INTEGRAL VOLTAGE CONVERTER

BACKGROUND

This application relates to low-voltage incandescent lamps of the type with tungsten filaments and, in particular, to lamps of the type having voltage-conversion circuitry built into the lamp.

It is known to provide incandescent lamps which operate at a voltage below the standard AC line voltage, typically 120 VAC. For example, lamps operating at 12 volts are known for a variety of applications. In some instances, a specialized fixture is provided for such lamps, the fixture including conversion circuitry for converting the AC line voltage to the operating voltage of the lamp.

It is also known to provide low-voltage lamps which are designed to be powered from standard AC line sockets or fixtures. In such lamps, the voltage conversion circuitry is incorporated into the lamp itself. Such a lamp is disclosed, for example, in U.S. Pat. No. 4,998,004, in which the conversion circuitry is disposed in the base and inside the envelope of the lamp. The lamp disclosed in that patent is a 40-watt incandescent bulb designed to operate at 15 volts. The wattage of the lamp is necessarily low because, at higher wattages, the temperature generated in the lamp may be damaging to the voltage conversion circuitry. In converting the line voltage to a lower voltage, the lamp current is increased, generating greater heat from the filament. In a halogen lamp, this high temperature is necessary in order to keep the halogen in cycle. The heat is conducted by the filament leads, is convected from the wall of the halogen capsule and is radiated from the filament, so that the temperature inside the envelope and the base builds up to a substantial level. For example, it has been found that for a 50-watt halogen lamp with reflector and lens, operated in a base-up configuration inside a recessed can fixture, the temperature inside the lamp base will reach in excess of 120° C. Many electronic components do not operate well at such temperatures. Additionally, the voltage conversion circuitry used in the lamp of U.S. Pat. No. 4,998,044 can itself generate additional heat.

In U.S. Pat. No. 6,147,457 there is disclosed a low-voltage incandescent lamp with an inverter driven by a control circuit which generates less heat than the conversion circuitry of the lamp of U.S. Pat. No. 4,998,044, but it does not solve the temperature problem, since most of the heat generated by a low-voltage lamp is generated by the filament.

The high temperatures which can be experienced in a low-voltage lamp affect not only semiconductor performance, but also the lifetime of electrolytic capacitors. If the lamp is one, such as a parabolic aluminized reflector ("PAR") halogen lamp, with a replaceable halogen capsule, the useful life of the conversion circuitry should be several times the life of the replaceable capsule and such lifetimes are not possible at the high temperatures experienced in low-voltage lamps, particularly when operated in a base-up configuration, except at very low wattages.

When the lamp is operated in a base down or horizontal configuration, heat buildup is less of a problem, so that high-heat-intolerant circuit components could be incorporated in the base of the lamp, except for the fact that the normal base does not typically have adequate room to accommodate the entire conversion circuitry.

SUMMARY

This application discloses an improved low-voltage incandescent lamp which avoids the disadvantages of prior lamps while affording additional structural and operating advantages.

An important aspect is the provision of a low-voltage incandescent lamp with a built-in voltage conversion circuit which can withstand high-temperature applications.

In connection with the foregoing aspects, a further aspect is the provision of a lamp of the type set forth which mounts high-temperature-intolerant portions of the conversion circuit at a location remote from the base.

In connection with the foregoing aspects, a further aspect is the provision of a lamp of the type set forth, wherein the high-temperature-intolerant portion of the conversion circuit is disposed externally of the lamp.

A still further aspect is the provision of the lamp of the type set forth which may be provided in reflectorized or non-reflectorized form and is mountable in a standard 120 VAC socket.

Certain ones of these and other aspects may be attained by providing an incandescent lamp adapted to be powered from a fixture connected to an ordinary source of AC line voltage, comprising: a base for connection into an associated fixture, an envelope having a light-transmitting portion connected to the base, a voltage conversion circuit for converting the AC line voltage to a lower output voltage, the conversion circuit having a high-temperature-tolerant portion disposed in the base and a high-temperature-intolerant portion disposed outside the envelope and the base, and a light-generating filament disposed in the envelope and adapted to be coupled to the output voltage for being powered thereby.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION

Figure 1:
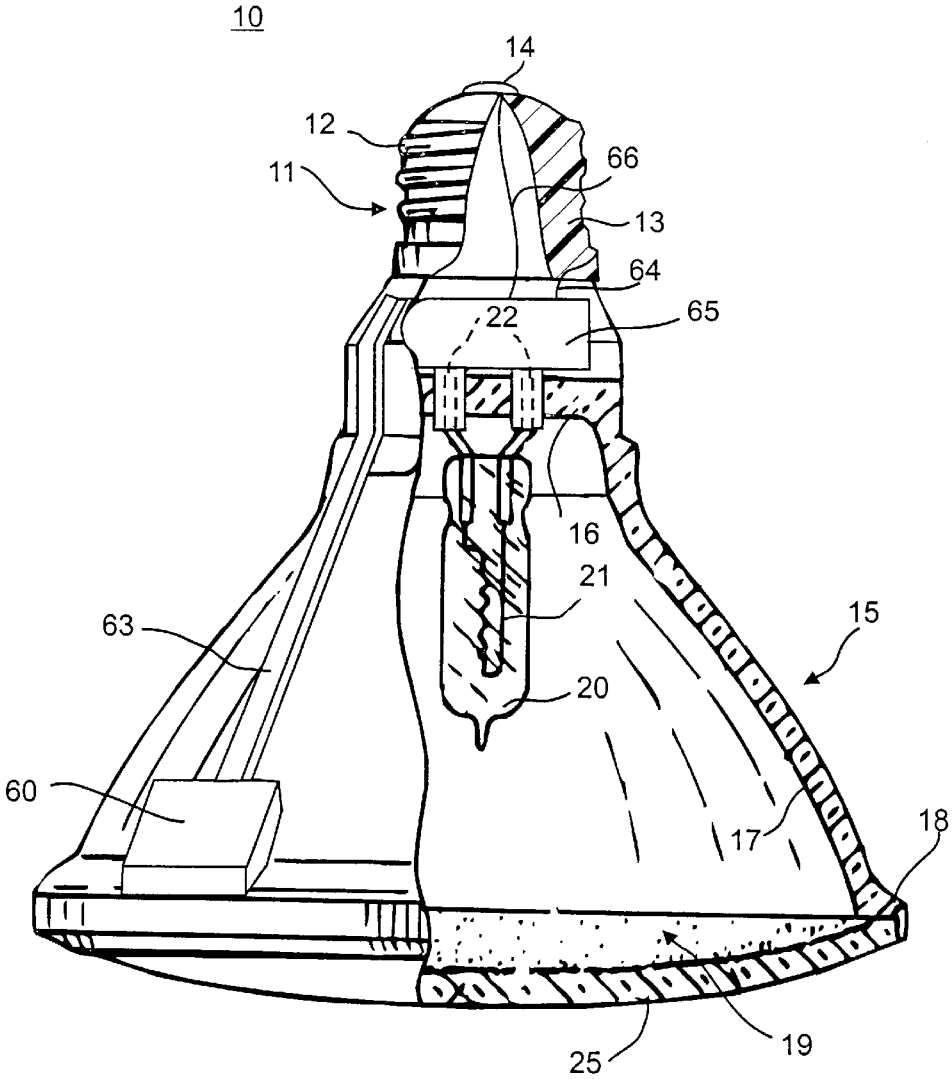
FIG. 1 is a side elevational view in partial section of a PAR halogen lamp embodiment.

Referring to FIG. 1, therein is illustrated a lamp 10, in the nature of a PAR incandescent lamp designed to operate at a lower voltage than the AC line voltage supplied to the socket in which the lamp is designed to be mounted. The lamp 10 has a standard Edison-type screw base 11 having an externally threaded metal shell 12, the lower end of which is separated by an insulator 13 from a conductive button terminal 14, in a known manner. The base 11 is connected to an envelope 15, which may be formed of a suitable glass material and has an end wall 16 and an internally reflectorized, generally frustoconical side wall 17, terminating at its distal end in an annular flange 18 which defines a wide mouth 19. Disposed in the envelope 15 is a halogen capsule 20, which includes a filament 21 having terminals 22 which extend through openings in the end wall 16. The mouth 19 is closed by a suitable light-transmitting lens 25, all in a known manner.

Figure 3:
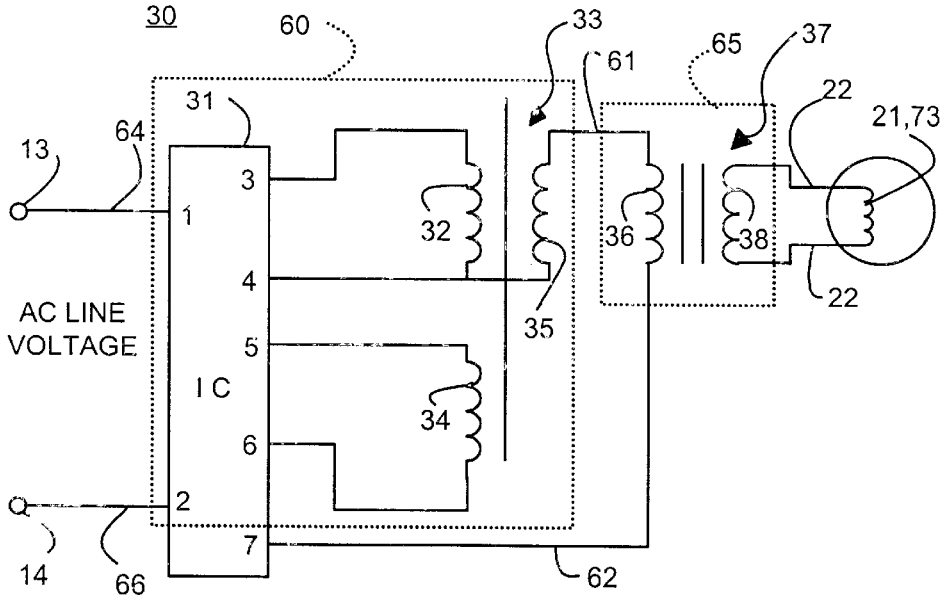
FIG. 3 is a schematic circuit diagram of the conversion circuit of the lamps of FIGS. 1 and 2.

Referring also to FIG. 3, the lamp 10 also has integrated therein a voltage conversion circuit 30 which includes a seven-pin integrated circuit 31, pins 3 and 4 of which are connected to a primary coil 32 of a positive feedback transformer 33. A primary coil 34 of the transformer 33 is connected across pins 5 and 6 of the IC 31. The transformer 33 also has a secondary coil 35, one terminal of which is connected to pin 4 of the IC 31, and the other terminal of which is connected to one terminal of the primary winding 36 of an output transformer 37, the other terminal of which winding is connected to pin 7 of the IC 31. The output transformer 37 has a secondary winding 38.

It is a significant aspect of the invention that the voltage conversion circuit 30 is separated into two portions, a high-temperature-intolerant portion 60 which includes the IC 31 and the positive feedback transformer 33, and a high-temperature-tolerant portion 65, which comprises the output transformer 37. As can be seen in FIG. 1, the portion 65 is disposed in the base 11 of the lamp 10, the secondary winding 38 of the transformer 37 being connected to the terminals 22 of the filament 21. The primary winding 36 of the transformer 37 is connected via conductors 61 and 62 to the portion 60 of the conversion circuit 30, which latter portion is disposed along the outer surface of the envelope 15 adjacent to the mouth 19. As can be seen in FIG. 1, the conductors 61 and 62 may be incorporated in a cable 63 which runs along the side surface of the envelope 15, and which also carries conductors 64 and 66 which connect pins 1 and 2 of the IC 31 to the base terminals 13 and 14. Accordingly, the output transformer 37, which may be relatively bulky, is disposed in the base 11, since it can tolerate the high temperatures which may be experienced there, while the portion 60 of the conversion circuit 30 is spaced from the base 11 at a lower-temperature portion of the lamp 10 where it will not be adversely affected by the heat which builds up in the base 11, even in base-up configurations.

Figure 4:
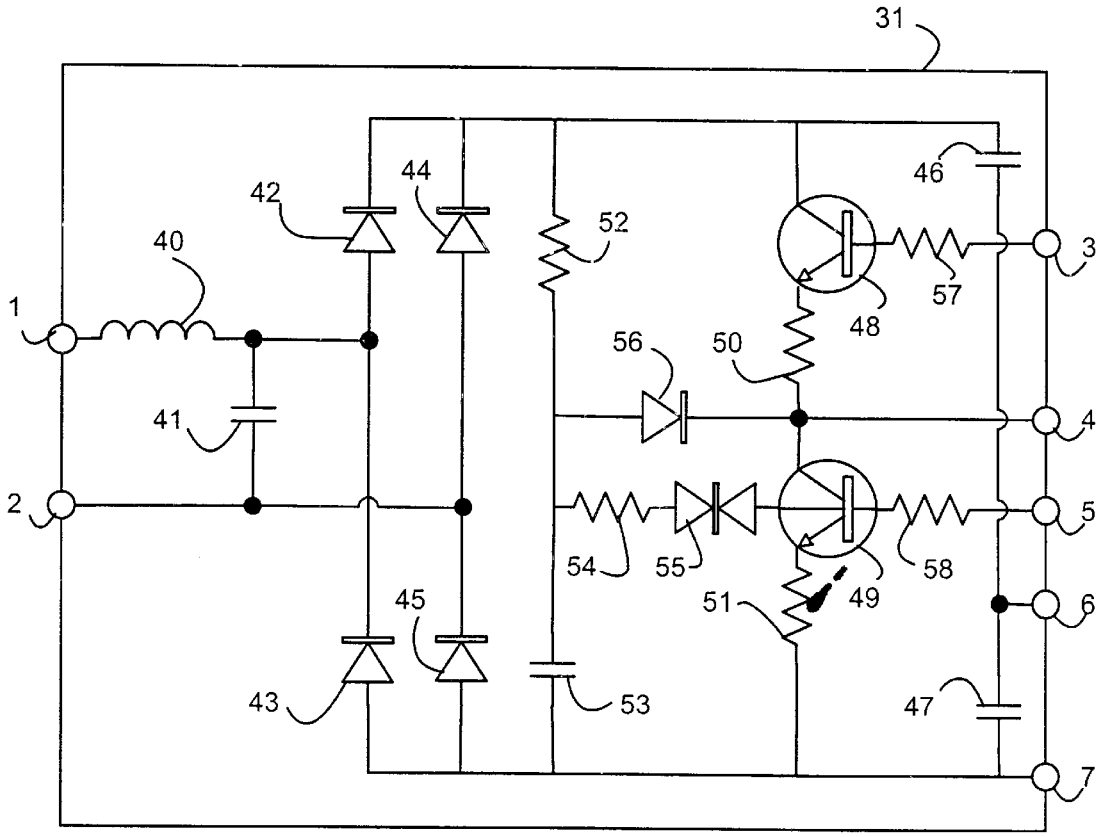
FIG. 4 is a schematic circuit diagram of the integrated circuit portion of the conversion circuit of FIG. 3.

Referring to FIG. 4, the details of the integrated circuit 31, which are fairly conventional, are illustrated. An inductor 40 and a capacitor 41 are connected across the pins 1 and 2 to eliminate electromagnetic interference. The junction between the inductor 40 and the capacitor 41, and pin 2 comprise the input terminals of a rectifying diode bridge including diodes 42–45, the output of the bridge being connected to a half-bridge inverter circuit which includes capacitors 46 and 47 connected in series across the output terminals of the rectifying bridge and transistors 48 and 49 connected in series across the rectifying bridge output. In particular, the collector of the transistor 48 is connected to one output terminal of the bridge rectifier, while its emitter is connected through a resistor 50 to the collector of the transistor 49, the emitter of which is connected through a resistor 51 to the other output terminal of the bridge rectifier. Also connected across the output terminals of the bridge rectifier are the series connection of a resistor 52 and a capacitor 53, the junction between which is connected through a resistor 54 and a diac 55 to a trigger input of the transistor 49. The junction between the resistor 52 and the capacitor 53 is also connected through a diode 56 to the collector of the transistor 49 and to pin 4 of the IC 31. The bases of the transistors 48 and 49 are respectively connected through resistors 57 and 58 to pins 3 and 5 of the IC 31. The junction between capacitors 46 and 47 is connected to pin 6, while the lower output terminal of the bridge rectifier is connected to pin 7.

In operation, the input AC line voltage is rectified by the diode bridge rectifier. The oscillation of the half bridge inverter is triggered by the diac 55, which is charged by the resistor 52 and the capacitor 53. Resistors 50 and 51 are used to stabilize the operating point of the transistors 48 and 49, while resistors 57 and 58 limit the base current of the transistors. The diode 56 makes sure that the capacitor 53 is fully discharged after the transistors are triggered into oscillation.

Figure 2:
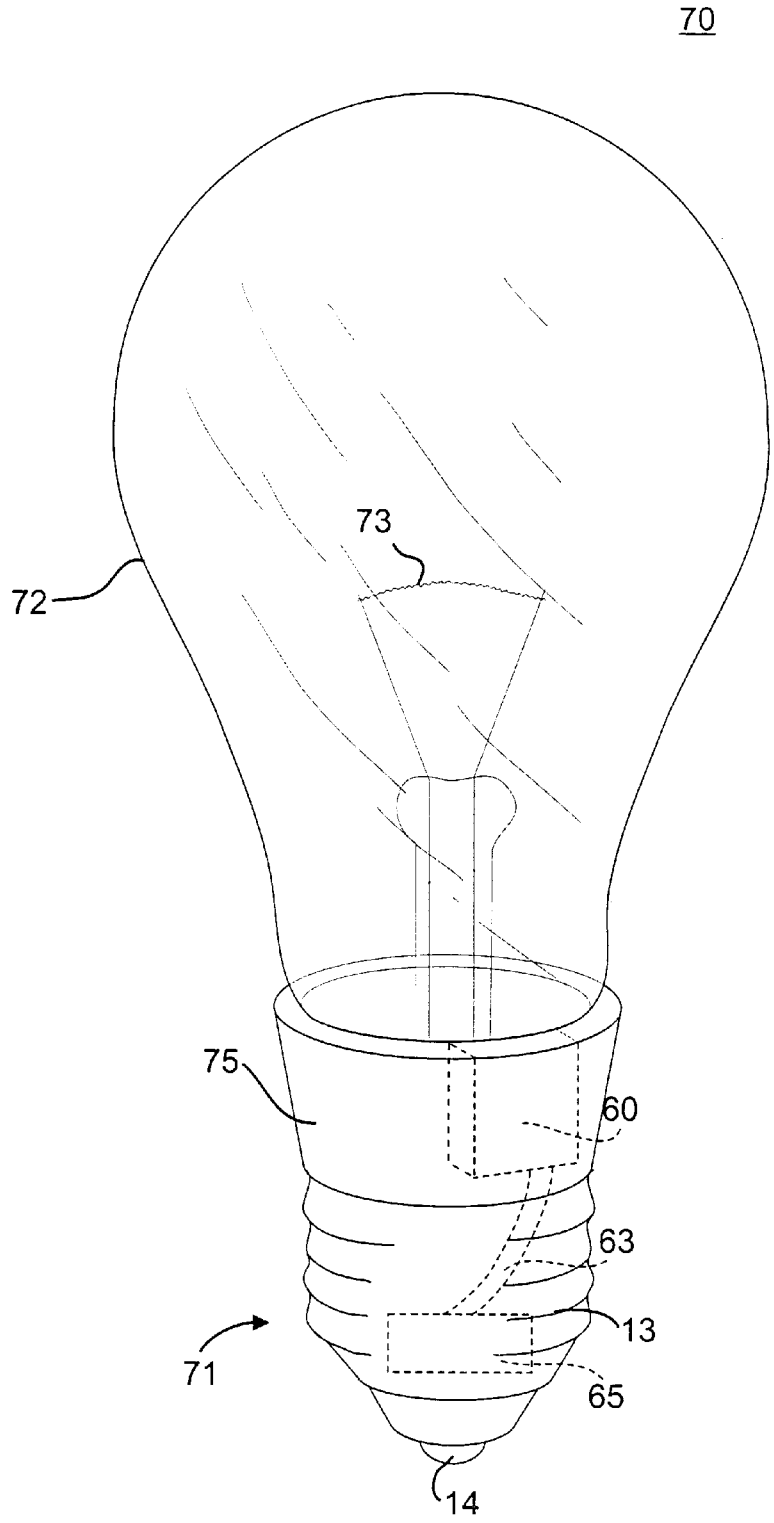
FIG. 2 is a perspective view of a non-reflectorized incandescent bulb.

Referring now to FIG. 2, there is illustrated an incandescent lamp 70 having a standard Edison-type screw base 71 with conventional terminals 13 and 14. Connected to the base 71 is a light-transmitting bulb envelope 72 which contains a filament 73. The high-temperature-tolerant portion 65 of the voltage conversion circuit 30 is disposed in the base 71, while the hightemperature-intolerant portion 60 thereof is disposed along the outside of the envelope 72 and within an enveloping skirt 75 which is connected to the base 71 and serves as an additional heat sink for heat which builds up in the base 71.

While two specific types of incandescent lamps have been illustrated, it will be understood that the principles of the invention may be applied to incandescent lamps with other types of envelopes, either reflectorized or non-reflectorized. In a typical embodiment the voltage conversion circuit 30 may convert a standard 120 VAC supply line voltage to a lamp operating voltage in the range of from about 12 to about 15 volts, but it will be appreciated that the principles of the invention apply to lamps operating at any desired voltage less than the AC line voltage.

The matter set forth in the foregoing description and accompanying drawings is offered by way of illustration only and not as a limitation. While particular embodiments have been shown and described, it will be obvious to those skilled in the art that changes and modifications may be made without departing from the broader aspects of applicants' contribution. The actual scope of the protection sought is intended to be defined in the following claims when viewed in their proper perspective based on the prior art.

What is claimed is:

1. An incandescent lamp adapted to be powered from a fixture connected to an ordinary source of AC line voltage, comprising:

a base for connection into an associated fixture, an envelope having a light-transmitting portion connected to the base, a voltage conversion circuit for converting the AC line voltage to a lower output voltage, the conversion circuit having a high-temperature-tolerant portion disposed in the base and a high-temperature-intolerant portion disposed outside the envelope and the base, and a light-generating filament disposed in the envelope and adapted to be coupled to the output voltage for being powered thereby.

2. The lamp of claim 1, wherein the base is a screw-type base for screwing into an internally threaded socket.

3. The lamp of claim 1, wherein substantially the entire envelope is light-transmitting.

4. The lamp of claim 1, wherein the envelope includes a light-transmitting lens.

5. The lamp of claim 1, wherein the high-temperature-tolerant portion includes an output transformer.

6. The lamp of claim 5, wherein the high-temperature-intolerant portion includes an integrated circuit.

7. The lamp of claim 1, wherein the filament is disposed in a halogen capsule.

8. An incandescent lamp adapted to be powered from a fixture connected to an ordinary source of AC line voltage, comprising:

a base for connection into an associated fixture, an aluminized reflector envelope connected to the base and diverging therefrom to a wide mouth, a voltage conversion circuit for converting the AC line voltage to a lower output voltage, the conversion circuit having a high-temperature-tolerant portion disposed in the base and a high-temperature-intolerant portion disposed outside the envelope and the base, and a light-generating filament disposed in the envelope and adapted to be coupled to the output voltage for being powered thereby.

9. The lamp of claim 8, wherein the base is a screw-type base for screwing into an internally threaded socket.

10. The lamp of claim 8, wherein the high-temperature-intolerant portion is disposed adjacent to the mouth of the envelope.

11. The lamp of claim 8, wherein the envelope includes a light-transmitting lens closing the mouth.

12. The lamp of claim 8, wherein the high-temperature-intolerant portion includes a positive feedback transformer.

13. The lamp of claim 8, wherein the high-temperature-intolerant portion includes an integrated circuit.

14. The lamp of claim 8, wherein the high-temperature-tolerant portion includes an output transformer.

15. The lamp of claim 8, wherein the filament is disposed in a halogen capsule.

16. An incandescent lamp adapted to be powered from a fixture connected to an ordinary source of AC line voltage, comprising:

a base for connection into an associated fixture, a light-transmitting envelope connected to the base, a voltage conversion circuit for converting the AC line voltage to a lower output voltage, the conversion circuit having a high-temperature-tolerant portion disposed in the base and a high-temperature-intolerant portion disposed outside the envelope and the base, and a light-generating filament disposed in the envelope and adapted to be coupled to the output voltage for being powered thereby.

17. The lamp of claim 16, and further comprising a skirt connected to the base and encircling an adjacent portion of the envelope for cooperation therewith to accommodate the high-temperature-intolerant portion therebetween.

18. The lamp of claim 16, wherein the high-temperature-intolerant portion includes a positive feedback transformer.

19. The lamp of claim 18, wherein the high-temperature-intolerant portion includes an integrated circuit.

20. The lamp of claim 16, wherein the high-temperature-tolerant portion includes an output transformer.

* * * * *